US009722357B1

(12) United States Patent
Helgeson et al.

(10) Patent No.: US 9,722,357 B1
(45) Date of Patent: Aug. 1, 2017

(54) TECHNOLOGY FOR MAINTAINING SECURE CONNECTIONS OF ELECTRONIC CABLING

(71) Applicant: International Business Machines Corporation, Armonk, NY (US)

(72) Inventors: Lee N. Helgeson, Rochester, MN (US); Jonathan L. Kaus, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/011,586

(22) Filed: Jan. 31, 2016

(51) Int. Cl.
*H01R 13/639* (2006.01)

(52) U.S. Cl.
CPC ..... *H01R 13/6395* (2013.01)

(58) Field of Classification Search
USPC ..... 439/371, 367, 373, 362, 345, 369
See application file for complete search history.

(56) References Cited

U.S. PATENT DOCUMENTS 4,045,108 A * 8/1977 Olsen ..... H01R 13/6395 439/368
4,105,274 A * 8/1978 Casey ..... H01R 13/6395 439/368
4,118,838 A * 10/1978 Schiefer ..... F16L 3/10 174/156
4,165,142 A * 8/1979 Grabau ..... H01R 13/6395 248/500
4,480,808 A * 11/1984 Reimer ..... F16L 3/10 24/115 R
4,652,069 A * 3/1987 Smith ..... H01R 13/6395 439/369
4,922,056 A * 5/1990 Larsson ..... G02B 6/444 174/650
5,655,924 A * 8/1997 Cross ..... H01R 13/6395 439/369
5,989,052 A * 11/1999 Fields ..... H01R 13/447 439/144

(Continued)

OTHER PUBLICATIONS

JW Winco, Inc. Latch Type Toggle Clamp, http://jwwinco.com/products/section15/gn853-ni/gn853-nida.gif, Sep. 24, 2014.

(Continued)

*Primary Examiner* — Alexander Gilman
(74) *Attorney, Agent, or Firm* — Anthony V. S. England; L. Jeffrey Kelly

(57) ABSTRACT

For a chassis having a port mounted on a side of the chassis and connected to electronics in the chassis, with a plug mated in the port and a cable connected to the plug, first and second supports are mounted on the chassis side on opposing sides of the port, where each support has a respective, predetermined length extending away from the chassis side. A strap defines a slot beginning at a first end of the strap and extending along a portion of the strap's length. The strap is placed with the cable inserted in the slot and the plug at a central portion of the strap. With the supports mounted on the chassis side on opposing sides of the port, the strap connected to the respective supports, at least the plug forces curvature in a central portion of the strap, so that the central portion of the strap clamps the plug.

19 Claims, 5 Drawing Sheets

(56) References Cited

U.S. PATENT DOCUMENTS 6,056,580 A * 5/2000 Cross ..... H01R 13/6392 439/369
6,071,142 A * 6/2000 Blackman ..... H01R 13/6395 439/373
6,095,846 A * 8/2000 Becerra ..... H01R 13/6395 439/371
6,176,728 B1 * 1/2001 Bonnet ..... G06F 1/184 361/800
6,276,952 B1 * 8/2001 Ferranti ..... H01R 13/6395 439/345
6,767,237 B1 * 7/2004 Shih ..... H01R 13/6392 439/371
6,855,006 B2 * 2/2005 Brooks ..... H01R 13/405 439/271
7,014,493 B1 * 3/2006 Battard ..... H01R 13/6395 439/371
7,037,133 B2 * 5/2006 Matsuo ..... H01R 13/73 439/527
7,101,215 B2 * 9/2006 Woellner ..... H01R 13/639 439/371
7,140,903 B2 * 11/2006 Pulizzi ..... H01R 13/5804 439/371
7,455,546 B1 * 11/2008 Yoon ..... H01R 13/6392 439/369
7,695,305 B1 * 4/2010 Ray ..... H01R 13/6395 439/359
7,722,380 B1 * 5/2010 West ..... H01R 13/6395 439/373
7,850,478 B2 * 12/2010 Lin ..... H01R 13/6395 439/372
8,337,236 B2 * 12/2012 Shu ..... H01R 13/6395 439/369
9,166,337 B2 * 10/2015 Boswell ..... H01R 13/6395
2015/0136473 A1 * 5/2015 Jafari ..... H02G 3/0691 174/656

OTHER PUBLICATIONS

Pegasus Auto Racing Part No. 3045—Adjustable Toggle Latch with Strike Plate, https://www.pegasusautoracing.com/Images/L/3045-2006.JPG, Oct. 24, 2015.

* cited by examiner

TECHNOLOGY FOR MAINTAINING SECURE CONNECTIONS OF ELECTRONIC CABLING

FIELD OF THE INVENTION

The field of the present invention concerns holding cable connectors in mated connection.

BACKGROUND

A cable for connecting electronic equipment typically has many individually-insulated conductors and may have a male plug on one end and a female plug on the other end, male plugs on both ends or female plugs on both ends. A connector in a fixed location, such as mounted in a chassis, may be referred to herein as a "jack" or a "port," while a moveable connector, such as on a cable, may be referred to as a "plug." The term "pin" is used herein for an element of a male connector electrically connected to a conductor. A pin mates with a "socket," which is an element of a female connector electrically connected to a conductor, as the term is used herein.

SUMMARY

An apparatus includes first and second supports mounted on a chassis, wherein a port is mounted on a side of the chassis and connected to electronics in the chassis. The first and second supports are mounted on the chassis side on opposing sides of the port. A strap of a predetermined length has first and second ends of the length respectively connected to the first and second supports. The strap defines a slot along a portion of its length, and the slot holds a cable connected to a plug that matches the port. A central portion of the strap is displaced when the strap's ends are connected to their respective supports, the displacement being due to the respective supports holding the respective ends of the strap at certain distances from the side of the chassis while at least the plug displaces the central portion of the strap further away from the side of the chassis, so that the central portion of the strap clamps the plug into engagement with the port.

An apparatus is for a chassis having a port mounted on a side of the chassis and connected to electronics in the chassis. The apparatus includes first and second supports mounted on the chassis side on opposing sides of the port. A strap of a predetermined length has first and second ends of the length respectively connected to the first and second supports. The strap defines a slot along a portion of its length for holding a cable connected to a plug that matches the port. The supports are of such lengths that with the supports mounted on the chassis side on opposing sides of the port, the strap connected to the respective supports, the cable in the slot and the plug mated with the port, at least the plug forces curvature in a central portion of the strap, so that the central portion of the strap clamps the plug into engagement with the port.

For a chassis having a port mounted on a side of the chassis and connected to electronics in the chassis, a method for clamping a plug mated in the port includes mounting first and second supports on the chassis side on opposing sides of the port, such that each support has a respective, predetermined length extending away from the chassis side. A strap of a predetermined length defines a slot beginning at a first end of the strap and extending along a portion of the strap's length. The strap is placed, which includes aligning a central portion of the strap with the plug, wherein the cable held in the slot and connecting the first strap end to the first support by slipping the first strap end under a lip of the first support The method also includes pushing the second strap end toward the chassis, until the second strap end is below a lip of the second support, wherein movement by the second strap end toward the chassis is opposed by at least the plug, so that movement of the second strap end toward the chassis due to the pushing forces curvature in the central portion of the strap.

The method further includes connecting the second strap end to the second support while holding the curvature in the strap by slipping the second strap end under the lip of the second support, wherein the predetermined lengths of the supports are such that with the supports mounted on the chassis side on opposing sides of the port, the strap ends connected to the respective supports, the cable in the slot and the plug mated with the port, the curvature is held in the central portion of the strap, so that the central portion of the strap clamps the plug in its mated position with the port.

BRIEF DESCRIPTION OF DRAWINGS

Novel features believed characteristic of the invention are set forth in the appended claims. The invention itself, however, as well as a preferred mode of use, objectives and advantages thereof, will best be understood by reference to the following detailed description of an illustrative embodiment when read in conjunction with the accompanying drawings, wherein:

DETAILED DESCRIPTION

A clamping device, according to embodiments of the present invention, holds a cable end connector firmly and squarely in connection with its mate and with appropriate pressure. This helps keep all connector pins in good contact with mating connector sockets, both initially and over time. This is useful, because it is often hard for a user to detect whether connectors on cables in computer systems are fully plugged into their sockets. One reason this may be hard is because objects such as other cables tend to be between a user and the connectors, so that visual confirmation of solid connection is not fully possible. It is also hard to hear whether male and female connectors are fully plugged in to one another, because connectors do not necessarily make a loud noise when they connect and because of noises in and around the connectors and their housing unit. It is also hard to feel whether a connector is fully plugged in, because connectors do not necessarily produce a substantial click feel when they connect, particularly if there is tension on a connector's cable. Consequently, the user is often unaware whether cables are fully connected to a system until the system is fully powered up and an error message occurs.

It is also particularly useful to hold a cable end connector firmly and squarely in connection with its mate and with appropriate pressure, as in embodiments of the present invention, because of the subtleties of errors that may arise with connectors. There are numerous pins involved with some cables. Many of these pins may get properly connected, while some do not. The lack of initial connection of some pins may not be immediately critical, particularly if signals on those disconnected pins are infrequent. For example, the disconnected pins may cause bit error rates to be higher than specified without causing outright failure. Further, pins may be initially connected but may become disconnected or less electrically secure over time due to weight of the cables and cable ends or due to users bumping the cables. Again, this may degrade the communications in a subtle fashion, such that a user might not even get an error message. Even when there is an error message, the message may not specifically isolate a fault. The message may, for example, state that there is no communication without stating that a specific cable is unplugged. Even if a connection is initially sufficient for communication, when a connector is not connected tightly enough to its mate, communication signals will generate more heat. Further, heat may not be dissipated properly by a heat sink for a connector when the connector is not positioned correctly relative to the heat sink.

Figure 1A:
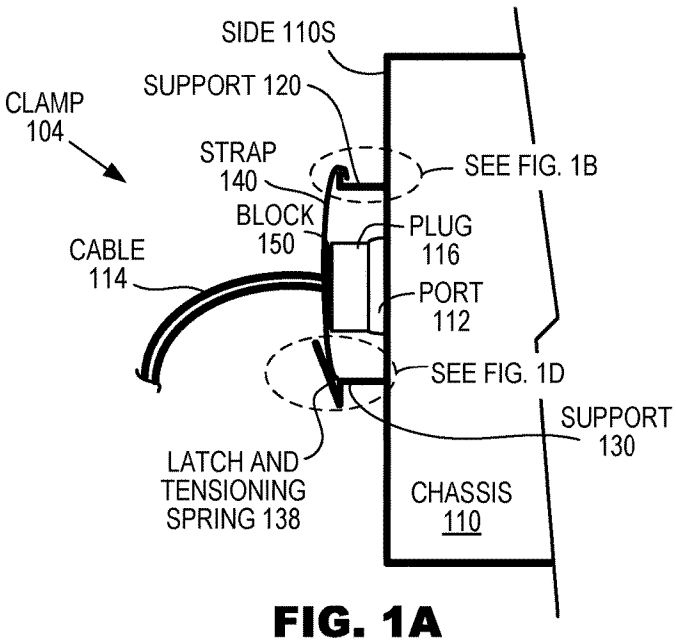
FIG. 1A is a side view of a chassis and connectors showing a clamp holding a single plug, according to embodiments of the present invention.

FIGS. 1A through 1D show a number of clamping devices, each clamping device holding a single cable end connector firmly and squarely in connection with its mate, according to embodiments of the present invention. FIG. 1A shows a chassis 110 that has a port 112 fixed in a side 110S thereof. A support 120 is rigidly mounted above a port 112 on chassis 110, so that support 120 extends from chassis 110. In FIG. 1A, the end of support 120 is visible, which provides a view of the cross-sectional shape of support 120. A cable 114 has its individual conductors (not shown) connected at one end to individual pins (not shown) of a plug 116, wherein plug 116 is mated with port 112.

Figure 1C:
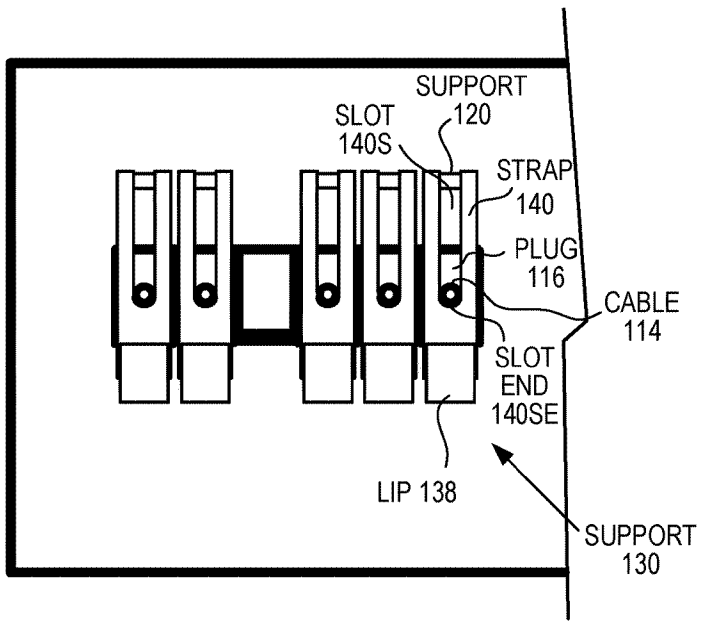
FIG. 1C is a front view of a chassis with a number of ports and having plugs clamped in respective ports by respective single-plug clamps, according to embodiments of the present invention.
Figure 1B:
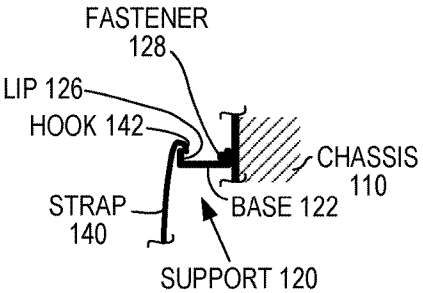
FIG. 1B is a more detailed side view of a portion of the clamp in FIG. 1A, according to embodiments of the present invention.

According to the embodiment illustrated, the cross-sectional shape of support 120 is approximately like that of a flat bracket ("["). Correspondingly, FIG. 1B shows that support 120 cross-section has an "L" shaped base 122, with the bottom of the "L" shape held by a fastener 128 to chassis 110, such as by a welded or brazed joint, rivet, screw or nut and bolt, for example, so that the top of the "L" shape extends in a substantially perpendicular fashion from the chassis 110 side 110S in which port 112 is mounted (FIG. 1A).

A lip 126 of base 120 extends substantially parallel to side 110S of chassis from the top of the "L" shape of base 120. Support 120 is positioned so that the free end of lip 126 extends away from port 112, so that when a strap 140 is positioned to hold plug 116 in a mated position with port 112, the end of a hook-shaped portion 142 on one end of strap 140 engages lip 126 of clamp support 120. ("Hook-shaped," or simply "hook," herein refers to a shape that makes a substantial turn back toward itself, such as at least 135 degrees, for example. For example, in FIG. 1B hook-shaped portion 142 has a complete 180 degree turn. The term "hook" does not necessarily imply that a hook shape is a single arc, or even an arc. For example, a "hook" may be formed in a rectilinear shape by a first lip extending from a base at a right angle and a second lip extending from the first lip at another right angle, or by the first lip extending from the base at about a 120 degree angle and a second lip extending from the first lip at about a 60 degree angle, etc. See hook shape 162 in FIG. 1E, for example, which is described herein below.)

As FIG. 1A shows, when in position for clamping plug 116 to port 112, strap 140 extends from support 120 to another support 130. Like support 120, support 130 includes an L-shaped base cross-sectional shape and is fastened to chassis 110 by the portion that is the bottom of the L-shape.

Figure 1D:
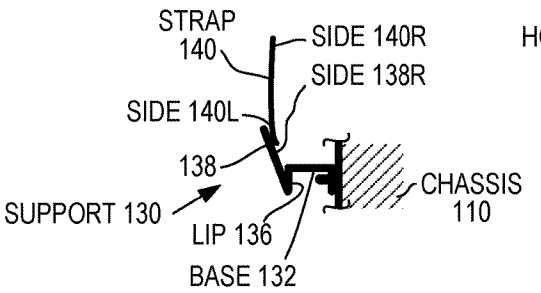
FIG. 1D is a more detailed side view of another portion of the clamp of FIG. 1A, according to embodiments of the present invention.

As shown in FIG. 1A together with FIG. 1D, support 130 has a lip 136 connected to the free end of its base portion 132, i.e., at the top of the L-shape, that is substantially parallel to side 110L and pointing away from port 112, like support 120. (In the illustrated embodiment, support 130 is fastened below port 112. It should be understood, of course, that the positions of supports 120 and 130 may be reversed, so that support 130 is above port 112 and support 120 is below. Or supports 120 and 130 may be mounted on each side of port 112, instead of above and below.) Support 130, unlike support 120, also includes an additional lip 138 extending back toward port 112 from the first lip, which may be referred to herein as a latch and tension spring element.

Supports 130 and 120 may be implemented in a variety of ways. Each may be a polymer or cast metal material, for example, or each may be a single metal sheet that includes bends such that each sheet forms the above described shape of base 122 and lip 126 or base 132 and lips 136 and 138, according to embodiments of the present invention. In alternative embodiments, each leg of base 122 and the lip 126 may each be a separate part of support 120 where the parts are attached to one another by welded or brazed joint, rivet, screw, nut and bolt, etc. The same applies to the legs of base 132 and the lips 136 and 138. Also, each base 122 and 132 may have an alternative shape, such as a "T" shape, where the top of the "T" attaches to chassis 110, or a "Z" shape, in which case the top of the "Z" may provide lip 136 or 126. Further, FIG. 1C shows five instances of support 130 and of support 120. It should be understood, however, that according to one or more other embodiments of the present invention a single, wider support 130 and a corresponding, wider support 120 may span multiple ports 112. For example, a single, wider support 130 and a corresponding, wider support 120 may span more than one port 112.

As shown in FIGS. 1A and 1B, strap 140 is made of a thin, flexible material, such as spring steel, according to one or more embodiments of the present invention, and has a small amount of curvature along its length from its hook-shaped portion 142 end to its end that engages element 138 of support 130. As shown in FIGS. 1A and 1D, the planes of lip 136 and element 138 form an acute angle, so that one end of strap 140 may be positioned for clamping purposes under latch and spring element 138, i.e., with one face 140L, which faces away from the side 110S of chassis 110, against side 138R of element 138 on support 130, which faces toward side 110S. The way that this facilitates clamping is described further herein below.

As shown in FIG. 1C, strap 140 forms a slot 140S along a sufficient portion of its length so that by inserting cable 114 in slot 140S, a substantial length of strap 140 may straddle cable 114. Strap 140 defines a slot end 140S at or near the middle of the length of strap 140, e.g., within +/−15% of the strap 140 length from the middle. The portions of strap 140 that straddle cable 114 on either side of slot 140S may be referred to as "legs."

As shown in FIGS. 1A through 1D and described below, with supports 120 and 130 mounted on chassis 110, a clamp 104 is provided, according to embodiments of the present invention, for holding plug 116 tightly against port 112 in chassis 110, which includes strap 140 connected to supports 120 and 130. In clamp 104, slot 140S of strap 140 straddles a cable 114 connected to plug 116. Clamp 104 may include block 150 between strap 140 and plug 116, as shown, to better fit the contour of curved strap 140 to the side of plug 116 that would otherwise abut strap 140.

Figure 2D:
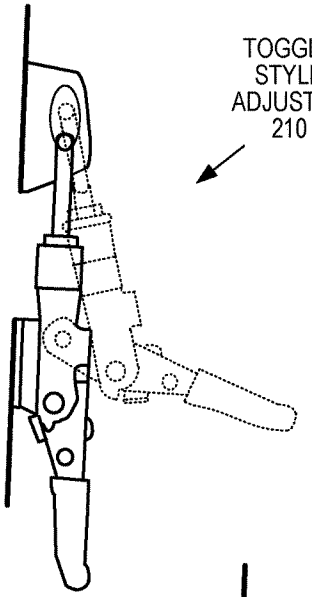
FIG. 2D illustrates a toggle style adjuster, according to embodiments of the present invention.
Figure 2F:
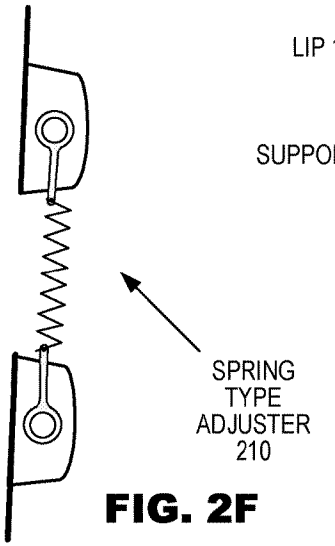
FIG. 2F illustrates a spring type adjuster, according to embodiments of the present invention.
Figure 2E:
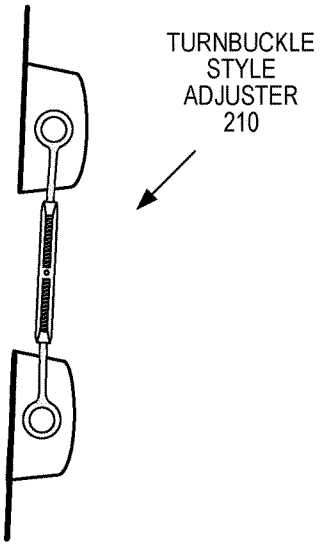
FIG. 2E illustrates a turnbuckle style adjuster, according to embodiments of the present invention.

More specifically, with side 140L at one end of strap 140 positioned against side 138R of element 138 on support 130 and cable 114 inserted in slot 140S, the opposing side 140R of strap 140 may be positioned against a block 150 that is inserted between strap 140 and a side of plug 116 that faces away from port 112, i.e., the side in which cable 114 is inserted. Block 150 may be a single, relatively thin gasket with a slot in the gasket so that the gasket may be positioned around cable 114 so that the gasket covers most of the side of plug 116 that faces strap 140. Alternatively, block 150 may be a single, relatively thick, slotted gasket or may be layers of more than one thin, slotted gasket. Alternatively, block 150 may be in two, unattached parts, one on each side of cable 114. See, for example, FIG. 2B. Each part may be a single layer or may be more than one, thinner layer. As shown in FIG. 2A, each block may be contoured to match the curvature of strap 140.

Returning again to FIGS. 1A through 1D, with strap 140 in this position and with hook-shaped portion 142 on the other end of strap 140 engaging unfastened lip 126 of support 120, strap 140 clamps plug 116 in its mated position against port 112. That is, in this position strap 140 and element 138 bend along its length such that the hook-shaped portion 142 end of strap 140 pulls on lip 126 in a direction away from chassis 110 thereby tending to hold strap 140 in contact with support 120. Likewise, on the opposite end of strap 140 the central bending causes side 140L to push against side 138R of element 138, which pulls on lip 136 in a direction away from chassis 110. Correspondingly, due to the bending the central portion of strap 140 produces a spring force toward chassis 110, which is transferred through block 150 to the side of plug 116 facing strap 140, i.e., the side of plug 116 in which cable 114 is inserted, thereby clamping plug 116 against port 112.

Note that in at least some embodiments, slot 140S is of sufficient length to permit hook-shaped portion 142 of strap 140 to engage with lip 126 but is short enough so that slot end 140SE engages cable 114 to stop movement of strap 140 so that hook-shaped portion 142 may not slip off lip 126.

Figure 1E:
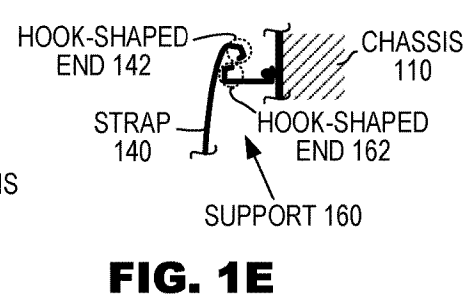
FIG. 1E is a view of a variation of the portion of the clamp of FIG. 1B, according to embodiments of the present invention.
Figure 1F:
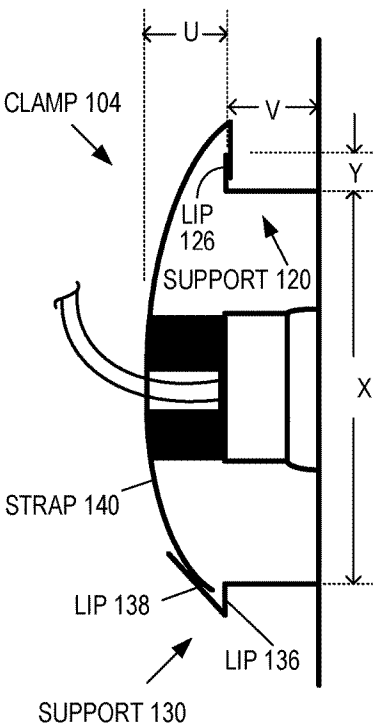
FIG. 1F is side view of a clamp showing certain dimensions, according to embodiments of the present invention.

Regarding dimensions, FIG. 1F illustrates dimensions for one embodiment of clamp 104 of FIG. 1A, for example. The width of the strap 140 may be determined by the size of the cable connector and cable itself. For some of the bigger optical bundles, the strap might be ½" to ¾" wide, for example, to ensure it has good coverage on the cable end, and still can fit around the bundle of fibers, which can be quite thick, such as ⅜" or more. Strap 140 may be Society of Automotive Engineers steel grade 1095 or 1074, for example, around 1/32" thick (~22 ga). A thicker or thinner piece of steel may be used depending on the desired amount of tension. Strap 140 may be spring steel with a thickness of 0.03125", for example, wherein a dimension X between supports may be 3.000", for example; the length of a lip such as lip 126 (dimension Y) may be 0.125", for example; a distance V between the side 110S of chassis 110 and the lip of a support, such as lip 126 of support 120, may be 0.500", for example; and the displacement U of an otherwise essentially flat strap 140, which is due to the ends of strap 140 being constrained by supports 130 and 140 while plug 116 and block 150 pushes the central portion of strap 140 away from the side 110S of chassis 110, may be 0.250", for example. For a multi-plug clamp 204 such as in FIG. 2A, but with no adjuster 210, the corresponding dimensions may be X=6.500", for example; Y=0.250", for example; V=0.500", for example; and U=0.500", for example. For a multi-plug clamp 204 with an adjuster 210 as in FIG. 2A, the corresponding dimensions may be X=8.000", for example; Y=0.250", for example; V=0.500", for example; and U=0.500", for example.

Figure 2C:
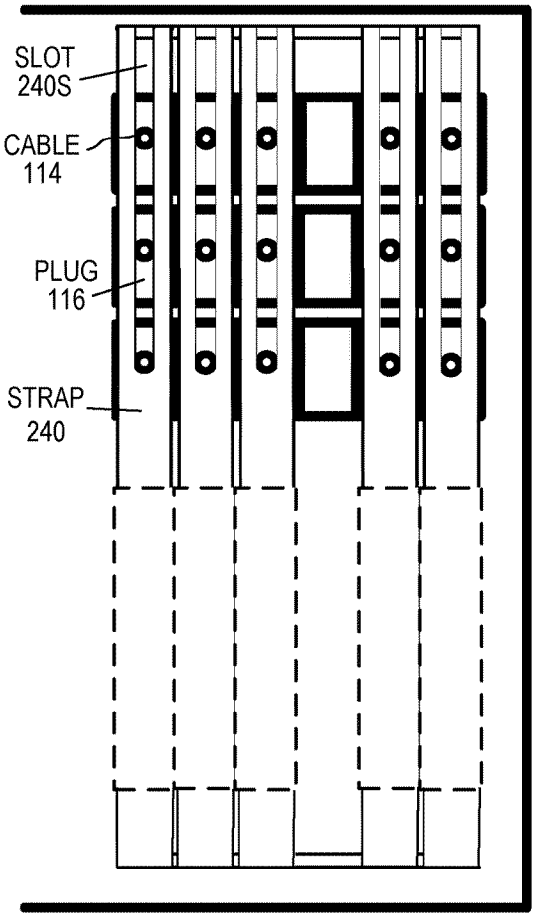
FIG. 2C is a front view of a chassis with a number of plugs clamped to respective ports, where sets of plugs are clamped in respective ports by respective multi-plug clamps, according to embodiments of the present invention.
Figure 2B:
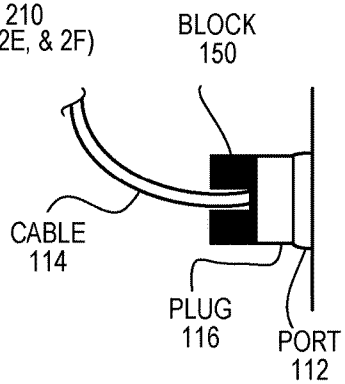
FIG. 2B is a view of the one plugs of FIG. 2A showing more detail of a block between the plug and a strap, according to embodiments of the present invention.
Figure 2A:
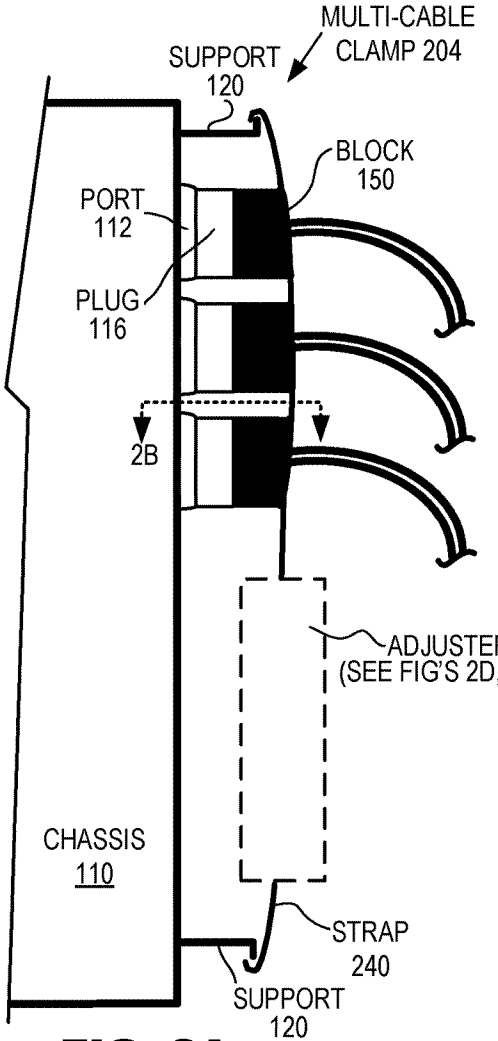
FIG. 2A is a side view of a chassis and connectors showing a multi-plug clamp, according to embodiments of the present invention.

FIGS. 2A through 2C show a number of clamping devices, where each clamping device is for more than one cable end connector, each cable end connector being held in connection with its respective mate, according to embodiments of the present invention. That is, with instances of support 120 mounted above and below three, vertically aligned ports 112 on chassis 110, and with strap 240 connected to supports 120, a multi-plug clamp 204 is provided once again, i.e., similar to clamp 104, but in this embodiment, multi-plug clamp 204 is for holding the three, vertically aligned plugs 116 tightly against their respective ports 112 in chassis 110 using one strap 240. In multi-plug clamp 204, strap 240 may have a longer slot 240S than in clamp 140, since the legs of strap 240 on either side of slot 240S straddle three cables 114 instead of one. Each cable 114 is connected to a single plug 116. Multi-plug clamp 204 may include block 150 between strap 240 and plug 116, as particularly shown in FIGS. 2A and 2B, to better fit the contour of curved strap 140 to the side of plug 116 that would otherwise abut strap 240.

The embodiments shown in FIGS. 2A through 2C, like those of FIGS. 1A through 1D, each block 150 may be a single, relatively thin gasket with a slot in the gasket so that the gasket may be positioned around cable 114, so that the gasket covers most of the side of plug 116 that faces strap 240, or may be a single, relatively thick, slotted gasket, or may be layers of more than one thin, slotted gasket. Each block 150 may, instead, be in two, unattached parts, one on each side of its cable 114, as shown FIG. 2B. Each part may be a single layer or may be more than one layer, where each layer is thinner. Each block 150 may be contoured to match the curvature of strap 140, as shown in FIG. 2A.

In the one or more embodiments illustrated in FIGS. 2A through 2C, an adjuster 210 is included in each strap 240, where the adjuster 210 is operable to increase or decrease the length of its strap 240. That is, in such embodiments each strap 240 has two parts and adjuster 210 making up its length, i.e., one end of adjuster 210 attached to one of the parts and the other end of adjuster attached to the other part. Accordingly, a user may operate adjuster 210 to lengthen strap before positioning it in engagement with supports 120 and then, once strap 240 is positioned in engagement with its supports 120, the user may operate the adjuster to shorten strap 240, thereby applying tension that pulls the strap 240 ends into tighter engagement with supports 120. In one or more embodiments, adjuster 210 may include a toggle latch as shown in FIG. 2D, wherein opening of toggle latch 210 (dashed lines in FIGS. 2A & 2C) increases the overall length of strap 240 and closing of toggle latch 210 shortens strap 240.

Alternatively, adjuster 210 may include a turnbuckle as shown in FIG. 2E, wherein rotating the turnbuckle around its long axis in one direction increases the overall length of strap 240 and rotating it in the other direction shortens strap 240. In yet another alternative, adjuster 210 may include a spring as shown in FIG. 2F, so that the length of strap 240 is increased by a user manually pulling the ends of strap 240 in opposite directions along the strap's length and the length of strap 240 is decreased by the user simply releasing the ends of strap 240.

Embodiments of the present invention may vary regarding supports 120 and 130. For example, although FIG. 1A shows one support 120 and one support 130, clamp 104 of FIG. 1A may be like multi-plug clamp 204 of FIG. 2A, i.e., may have matching supports 120, except that clamp 104 may still have a single-part strap 140 that is shorter than strap 240 and with a shorter slot 140S, as well. Likewise, although FIG. 2A shows matching supports 120, multi-plug clamp 204 may be like clamp 104 of FIGS. 1A through 1D, i.e., may have a one support 120 and one support 130, except that multi-plug clamp 204 may have a strap 240 that is longer than strap 140 and a slot 240S that is longer than slot 140S, since strap 240 extends across three plugs 116 instead of just one. In yet another alternative, a clamp such as clamp 104 or multi-plug 204 may have two supports 130 instead of two supports 120 or one support 120 and one support 130.

Still further, embodiments of the present invention may have supports configured differently than either support 120 or support 130. For example, recall that support 120 shown in detail in FIG. 1B has a single lip 126 extending from base 122 parallel to side 110S of chassis 110, i.e., the side in which port 112 is installed. FIG. 1E illustrates an alternative embodiment. The end 142 of strap 140 and the end 162 of support 160 are not yet engaged in FIG. 1E, so that the shapes of end 142 and end 162 may be clearly identified. Support 160 of FIG. 1E is like that of support 120 in FIG. 1B, except that support 160 has an additional lip on the free end that extends back toward chassis 110, so that the free end 162 of support 160 has a hook shape like that on end 142 of strap 140. This configuration is advantageous because the extra lip on the free end of support 160 prevents clamp 140 from being pushed off support 160 by a force in a direction parallel to side 110S.

Also, referring to FIGS. 1A and 2A, embodiments of the present invention may vary regarding adjusters 210. For example, a multi-plug clamp 204 may, like the single-plug clamp 104 illustrated in FIG. 1A, have no adjuster 210 and may, correspondingly, not be divided into two parts. Likewise, a single-plug clamp 104 may, like the multi-plug clamp 204 illustrated in FIG. 2A, have two parts and an adjuster 210 making up its length.

Figure 3C:
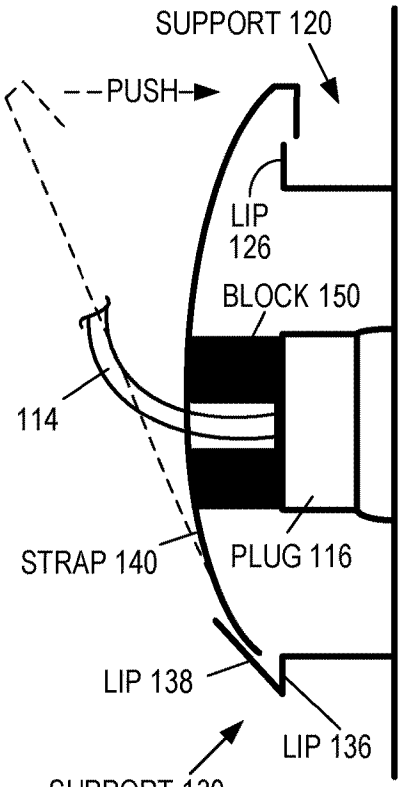
FIGS. 3A through 3E illustrate actions in one or more methods for clamping, according to embodiments of the present invention.
Figure 3B:
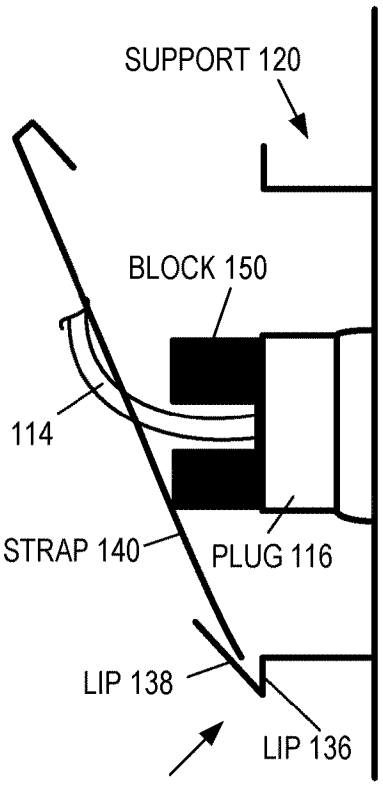
Figure 3A:
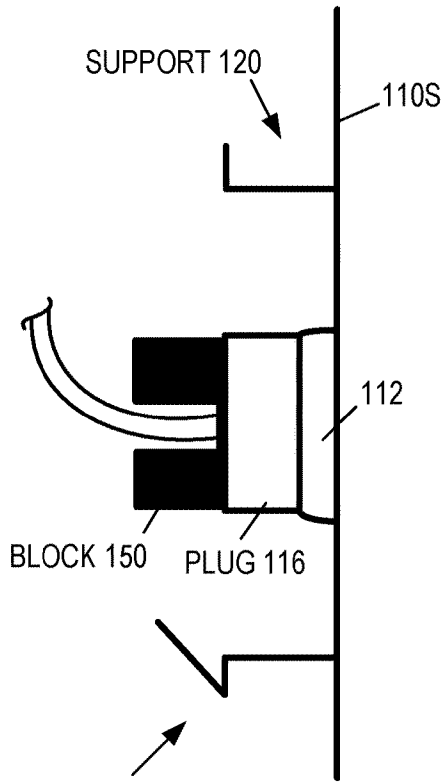

FIG. 3A through 3E illustrate a method of clamping connectors using the apparatus described hereinabove, for example, according to embodiments of the present invention. For a chassis having a port 112 mounted on a side 110S of the chassis and connected to electronics in the chassis, a method for clamping a plug 116 mated in port 112 includes mounting a and second supports, such as support 120 and support 130, on the chassis side 110S on opposing sides of port 112, such that each support has a respective, predetermined length extending away from the chassis side 110S, as shown in FIG. 3A. That is, lip 126 of support 120 and lip 136 of support 130 each extend away a predetermined distance from side 110S.

In FIG. 3B, a block 150 is inserted on plug 116. The lengths of supports 120 and 130 are such that lips 126 and 136 extend further from side 110S than block 150. (Block 150 sits on plug 116, as shown, but is optional. In other embodiments, where block 150 is omitted, the lengths of supports 120 and 130 are such that lips 126 and 136 extend further from side 110S than plug 116.) Thus, after placing strap 140 as shown in FIG. 3B, which includes slipping one strap 140 end (a flat end, in this case) under lip 138 of the first support, i.e., between lip 138 and chassis side 110S, which may include contacting lip 138. Accordingly, this end of strap 140 may, at this point, be referred to as the "captured" end, while the other end may, at this point, be referred to as the "free" end. Thus, movement of the free end of strap 140 (a hooked end, in this case) toward the chassis side 110S is opposed by lip 138 against the captured end of strap 140 and also by the combined distance that plug 116 and block 150 extend away from chassis side 110S.

Note that strap 140 may originally be flat or at least substantially flat along the major portion of its length as shown in FIG. 3B, according to embodiments of the present invention, but after being placed in the position shown in FIG. 3B, also shown by dashed line in FIG. 3C, a user pushes the free end of strap 140 toward chassis side 110S, causing the central portion of strap 140 to curve as shown by solid line in FIG. 3C. Due to presence of block 150, the curvature in the central portion of strap 140 is greater than the curvature would be without block 150. (Alternatively, strap 140 may originally be curved somewhat, so that it is not as flat as shown by dashed line in FIG. 3C, but the user forces even more curvature to position the free end of strap 140 as shown by the solid line in FIG. 3C.)

Figure 3E:
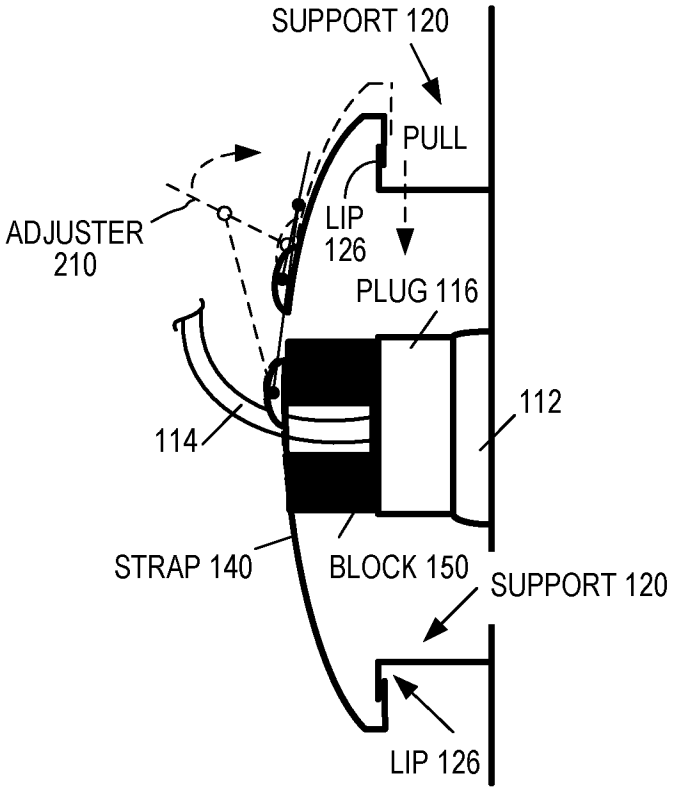
Figure 3D:
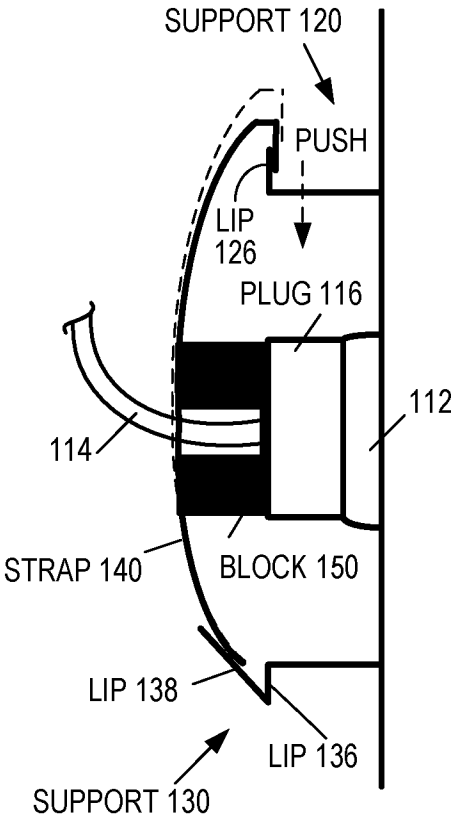

Note also that strap 140 is of a predetermined length that is long enough to allow strap 140 to extend from lip 138 of support 130 to slightly beyond lip 126 of support 120 despite being curved as shown in FIG. 3C, but short enough such that the end of the hook of strap 140 may be slid into position, as shown in FIG. 3D, between lip 126 and chassis side 110S once the hooked end of strap 140 has been pushed toward chassis side 110S enough to clear lip 126, as shown in FIG. 3C.

Also, as previously described, the strap defines a slot beginning at one of the strap ends and extending along a portion of the strap's length. Consequently, placing the strap as shown in FIG. 3B includes inserting cable 114 in the slot and positioning plug 116, which is connected to cable 114 and mated with port 112, at a central portion of strap 140 and with cable 114 held in the slot. Thus, the predetermined lengths of the supports are such that with the supports mounted on the chassis side on opposing sides of the port, the strap ends connected to the respective supports, the cable in the slot and the plug mated with the port, the curvature is held in the central portion of the strap, so that the central portion of the strap clamps the plug in its mated position with the port.

In an alternative to the way shown in FIG. 3E for slipping the hook end of strap 140 under lip 126, another way is shown in FIG. 3E, wherein strap 140 includes an adjuster 210 configured to decrease the predetermined length of the strap, i.e., like strap 240 of FIG. 2A. In the way illustrated, adjuster 210 is a toggle latch like the one shown in FIG. 2D. Thus, once in the position shown in FIG. 3D, the user operates the adjuster to decrease the length of strap 140, causing the end at the top of FIG. 3E to slip under lip 126. Note that this way of slipping the hook end of strap 140 under lip 126, i.e., the end at the top of FIG. 3E, is well suited to using the same type of support 120 for both the top and bottom supports.

FIG. 3A shows one support 120 and one support 130. However, as previously stated, there may be matching supports 120, instead, or there may be matching supports 130. Without the adjuster 210, the overall arrangement may be better suited to have one support 130 and one support 120 because support 130 allows strap 140 to be slid parallel to chassis side 110S into position under lip 126 as shown in FIG. 3D.

It should be appreciated that although FIGS. 3A through 3E show strap 140 and only one plug, strap 140 may be longer, like strap 240 and may span more than one port, as in FIG. 2A (with or without adjuster 210).

It should be appreciated that the device described in the present invention ensures cable connectors are fully plugged in with the correct force, protects the connectors from shock and vibration wear during shipment and system run-time, provides adjustable levels of tension for securing cables in place for application to a variety of cables, provides connection enhancements for pin contacts, helps with electrostatic discharge protection, and holds the cable and connector in place to take advantage of a heat sink, and helps decrease heat generation.

While this specification contains many specifics, these should not be construed as limitations on the scope of the invention or of what can be claimed, but rather as descriptions of features specific to particular implementations of the invention. Certain features that are described in this specification in the context of separate implementations can also be implemented in combination in a single implementation. Conversely, various features that are described in the context of a single implementation can also be implemented in multiple implementations separately or in any suitable sub combination. Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described program components can generally be integrated together in a single component or device.

Those skilled in the art having read this disclosure will recognize that changes and modifications may be made to the embodiments without departing from the scope of the present invention.

It should be appreciated that the particular implementations shown and described herein are illustrative of the invention and its best mode and are not intended to otherwise limit the scope of the present invention in any way. Other variations are within the scope of the following claims.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims.

As used herein, the terms comprises, comprising, or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as essential or critical.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The embodiments presented herein were chosen and described in order to best explain the principles of the invention and the practical application and to enable others of ordinary skill in the art to understand the invention for various embodiments with various modifications as are suited to the particular use contemplated. The description of the present invention has been presented for purposes of illustration and description, but is not intended to be exhaustive or limited to the invention in the form disclosed.

The invention claimed is:

1. An apparatus comprising:

first and second supports mounted on a chassis, wherein a port is mounted on a side of the chassis and connected to electronics in the chassis, the first and second supports being mounted on the chassis side on opposing sides of the port; and a strap of a predetermined length with first and second ends of the length respectively connected to the first and second supports, wherein the strap defines a slot along a portion of its length and the slot holds a cable connected to a plug that matches the port, wherein a central portion of the strap is displaced when the strap's ends are connected to their respective supports, the displacement being due to the respective supports holding the respective ends of the strap at certain distances from the side of the chassis while at least the plug displaces the central portion of the strap further away from the side of the chassis, so that the central portion of the strap clamps the plug into engagement with the port, and wherein the strap includes an adjuster configured to adjust the length of the strap.

2. The apparatus of claim 1 wherein the strap is essentially flat along its length when not connected to the supports and has its central portion displaced by curvature of the strap when the strap's ends are connected to their respective supports.

3. The apparatus of claim 2, further comprising a block between the plug and the strap having a surface conformed to the curvature of the strap.

4. The apparatus of claim 1 wherein the first and second ends of the length are held to the respective supports by slip connections.

5. The apparatus of claim 4, wherein the first support has a lip facing away from the port and the first strap end has a hook-shaped portion facing the port, wherein the displacement causes the lip to be held in a slip connection within the hook-shaped portion of the strap.

6. The apparatus of claim 4, wherein the second support includes a lip facing toward the port, wherein the displacement causes the second strap end to be held in a slip connection against the lip.

7. The apparatus of claim 4, wherein the second support includes a first lip facing away from the port and a second lip facing toward the port, the first and second lips forming an acute angle, wherein with the second strap end between the first and second lip, the displacement causes the second strap end to be held in a slip connection against the second lip.

8. The apparatus of claim 1, wherein a plurality of ports are mounted on the chassis and a plurality of cables are held within the slot, the cables being connected to respective plugs that match multiple respective ports.

9. An apparatus for a chassis having a port mounted on a side of the chassis and connected to electronics in the chassis, the apparatus comprising:

first and second supports mounted on the chassis side on opposing sides of the port; and a strap of a predetermined length with first and second ends of the length respectively connected to the first and second supports, wherein the strap defines a slot along a portion of its length for holding a cable connected to a plug that matches the port, wherein the supports are of such lengths that with the supports mounted on the chassis side on opposing sides of the port, the strap connected to the respective supports, the cable in the slot and the plug mated with the port, at least the plug forces curvature in a central portion of the strap, so that the central portion of the strap clamps the plug into engagement with the port, and wherein the strap includes an adjuster configured to adjust the length of the strap.

10. The apparatus of claim 9 wherein the strap is essentially flat along its length when not connected to the supports and has its central portion displaced by curvature of the strap when the strap's ends are connected to their respective supports.

11. The apparatus of claim 10, further comprising a block between the plug and the strap having a surface conformed to the curvature of the strap.

12. The apparatus of claim 9 wherein the first and second ends of the length are held to the respective supports by slip connections.

13. The apparatus of claim 12, wherein one of the supports has a lip facing away from the port and one of the strap ends has a hook-shaped portion facing the port, wherein the displacement causes the lip to be held in a slip connection within the hook-shaped portion of the strap.

14. The apparatus of claim 13, wherein the first and second supports each have a lip facing away from the port and each of the strap ends has a hook-shaped portion facing the port, wherein the displacement causes each lip to be held in a slip connection within a respective one of the hook-shaped portions of the strap.

15. The apparatus of claim 12, wherein one of the supports has a lip facing toward the port, wherein the displacement causes the first strap end to be held in a slip connection against the lip.

16. The apparatus of claim 15, wherein the first and second supports each have a lip facing toward the port, wherein the displacement causes each strap end to be held in a slip connection against respective ones of the lips.

17. For a chassis having a port mounted on a side of the chassis and connected to electronics in the chassis, a method for clamping a plug mated in the port, comprising:

mounting first and second supports on the chassis side on opposing sides of the port, such that each support has a respective, predetermined length extending away from the chassis side;

placing a strap of a predetermined length, wherein the strap defines a slot beginning at a first end of the strap and extending along a portion of the strap's length, wherein placing the strap includes:

aligning a central portion of the strap with the plug, wherein the cable held in the slot; and connecting the first strap end to the first support by slipping the first strap end under a lip of the first support;

pushing the second strap end toward the chassis until the second strap end is below a lip of the second support, wherein movement by the second strap end toward the chassis is opposed by at least the plug, so that movement of the second strap end toward the chassis due to the pushing forces curvature in the central portion of the strap; and connecting the second strap end to the second support while holding the curvature in the strap by slipping the second strap end under the lip of the second support, wherein the predetermined lengths of the supports are such that with the supports mounted on the chassis side on opposing sides of the port, the strap ends connected to the respective supports, the cable in the slot and the plug mated with the port, the curvature is held in the central portion of the strap, so that the central portion of the strap clamps the plug in its mated position with the port, wherein the strap includes an adjuster configured to decrease the predetermined length of the strap and slipping the second end of the strap under the lip of the second support comprises:

pulling the second end of the strap toward the first support by operating the adjuster.

18. The method of claim 17, further comprising:

placing a block on the plug such that movement by the second strap end toward the chassis is opposed by both the plug and the block and the curvature in the central portion of the strap is greater than the curvature would be without the block.

19. The method of claim 17, wherein slipping the second end of the strap under the lip of the second support comprises:

pushing the second end of the strap toward the first support.

* * * * *